US012799556B2

(12) United States Patent
Hata et al.

(10) Patent No.: US 12,799,556 B2
(45) **Date of Patent: *Nov. 17, 2026**

(54) STEEL SHEET, MEMBER, AND METHODS FOR MANUFACTURING THE SAME

(71) Applicant: JFE Steel Corporation, Tokyo (JP)

(72) Inventors: Katsuya Hata, Tokyo (JP); Shimpei Yoshioka, Tokyo (JP); Shinjiro Kaneko, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 405 days.

This patent is subject to a terminal disclaimer.

(21) Appl. No.: 18/277,874

(22) PCT Filed: Jan. 28, 2022

(86) PCT No.: PCT/JP2022/003320

§ 371 (c)(1),
(2) Date: Aug. 18, 2023

(87) PCT Pub. No.: WO2022/185804

PCT Pub. Date: Sep. 9, 2022

(65) Prior Publication Data

US 2024/0132986 A1 Apr. 25, 2024
US 2024/0229180 A9 Jul. 11, 2024

(30) Foreign Application Priority Data

Mar. 2, 2021 (JP) ..... 2021-032530

(51) Int. Cl.

| | |
|---|---|
| ***C21D 9/46*** | (2006.01) |
| ***C21D 1/18*** | (2006.01) |
| ***C21D 6/00*** | (2006.01) |
| ***C21D 8/02*** | (2006.01) |
| ***C21D 8/0221*** | (2026.01) |
| ***C21D 8/0247*** | (2026.01) |
| ***C21D 8/0278*** | (2026.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |

(Continued)

(52) U.S. Cl.

CPC ..... *C21D 9/46* (2013.01); *C21D 1/18* (2013.01); *C21D 6/001* (2013.01); *C21D 6/002* (2013.01); *C21D 6/005* (2013.01); *C21D 6/008* (2013.01); *C21D 8/02* (2013.01); *C21D 8/0226* (2013.01); *C21D 8/0236* (2013.01); *C21D 8/0263* (2013.01); *C21D 8/0278* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/22* (2013.01); *C22C 38/24* (2013.01); *C22C 38/28* (2013.01); *C22C 38/34* (2013.01); *C22C 38/38* (2013.01); *C22C 38/60* (2013.01); *C21D 2211/001* (2013.01); *C21D 2211/002* (2013.01); *C21D 2211/008* (2013.01)

(58) Field of Classification Search

CPC ..... B32B 15/012; B32B 15/013; C21D 2211/001; C21D 2211/002; C21D 1/26; C21D 2211/008; C21D 6/005; C21D 6/008; C21D 8/0205; C21D 8/0226; C21D 8/0236; C21D 8/0263; C21D 8/0273; C21D 9/46; C22C 38/02; C22C 38/04; C22C 38/38

See application file for complete search history.

(56) References Cited

U.S. PATENT DOCUMENTS

| | | | |
|---|---|---|---|
| 9,464,337 | B2 | 10/2016 | Mukai et al. |
| 2018/0100212 | A1 | 4/2018 | Ono et al. |

(Continued)

FOREIGN PATENT DOCUMENTS

| | | | |
|---|---|---|---|
| CN | 112074620 | A | 12/2020 |
| EP | 3 309 273 | A1 | 4/2018 |

(Continued)

OTHER PUBLICATIONS

The Extended European Search Report issued Jul. 3, 2024, by the European Patent Office in corresponding European Patent Application No. 22 762 863.3-1103. (11 pages).

(Continued)

*Primary Examiner* — Jie Yang

(74) *Attorney, Agent, or Firm* — Buchanan Ingersoll & Rooney PC

(57) ABSTRACT

A steel sheet has a chemical composition containing, by mass %, C: 0.20% or more and 0.40% or less, Si: more than 1.0% and 3.0% or less, Mn: 1.5% or more and 3.5% or less, P: 0.002% or more and 0.010% or less, S: 0.0002% or more and 0.0020% or less, sol. Al: 0.40% or less (not including 0%), and N: 0.0100% or less, with the balance being Fe and incidental impurities; and a steel microstructure containing, in area fraction, tempered martensite: 45% or more and 83% or less, bainite: 15% or more and 53% or less, and retained austenite: 2% or more. Carbides in the tempered martensite have an average particle size of 0.40 μm or less, an average amount of C in the retained austenite is 0.5% by mass or more, and a tensile strength is 1,470 MPa or more.

16 Claims, No Drawings

(51) Int. Cl.

| | |
|---|---|
| ***C22C 38/14*** | (2006.01) |
| ***C22C 38/16*** | (2006.01) |
| ***C22C 38/22*** | (2006.01) |
| ***C22C 38/24*** | (2006.01) |
| ***C22C 38/28*** | (2006.01) |
| ***C22C 38/34*** | (2006.01) |
| ***C22C 38/38*** | (2006.01) |
| ***C22C 38/60*** | (2006.01) |

(56) References Cited

U.S. PATENT DOCUMENTS

| | | | | |
|---|---|---|---|---|
| 2019/0003009 | A1 | 1/2019 | Kawata et al. | |
| 2021/0155999 | A1* | 5/2021 | Yokoyama | C22C 38/46 |
| 2021/0230712 | A1 | 7/2021 | Yokoyama et al. | |
| 2021/0355559 | A1 | 11/2021 | Ono et al. | |
| 2022/0002827 | A1 | 1/2022 | Hirashima et al. | |
| 2022/0220577 | A1 | 7/2022 | Hirashima et al. | |
| 2025/0179602 | A1* | 6/2025 | Yoshioka | C22C 38/08 |

FOREIGN PATENT DOCUMENTS

| | | | |
|---|---|---|---|
| EP | 3 715 493 | A1 | 9/2020 |
| EP | 3786310 | A1 | 3/2021 |
| JP | 2010065272 | A | 3/2010 |
| JP | 5412182 | B2 | 2/2014 |
| JP | 6288394 | B2 | 3/2018 |
| JP | 6291289 | B2 | 3/2018 |
| JP | 6540162 | B2 | 7/2019 |
| KR | 10-2018-0016518 | A | 2/2018 |
| KR | 10-2020-0093002 | A | 8/2020 |
| WO | 2016152163 | A1 | 9/2016 |
| WO | 2019208556 | A1 | 10/2019 |
| WO | 2020080402 | A1 | 4/2020 |
| WO | 2020090303 | A1 | 5/2020 |
| WO | 2020230796 | A1 | 11/2020 |

OTHER PUBLICATIONS

International Search Report and Written Opinion for International Application No. PCT/JP2022/003320, dated Mar. 15, 2022, 5 pages.

Office Action (The First Office Action) issued Apr. 10, 2025, by the State Intellectual Property Office of People's Republic of China in corresponding Chinese Patent Application No. 202280017676.4 and an English translation with Concise explanation of relevance of the Office Action. (17 pages).

Office Action (Request for the Submission of an Opinion) issued Apr. 15, 2025, by the Korean Intellectual Property Office in corresponding Korean Patent Application No. 10-2023-7028536 and an English translation with the Concise Statement of Relevance of Office Action. (16 pages).

Leslie, W., The Physical Metallurgy of Steels, 1985, 3 pages, Maruzen Co., Ltd., with English translation of relevant parts.

* cited by examiner

STEEL SHEET, MEMBER, AND METHODS FOR MANUFACTURING THE SAME

CROSS REFERENCE TO RELATED APPLICATIONS

This is the U.S. National Phase Application of PCT/JP2022/003320, filed Jan. 28, 2022, which claims priority to Japanese Patent Application No. 2021-032530, filed Mar. 2, 2021, the disclosures of these applications being incorporated herein by reference in their entireties for all purposes.

FIELD OF THE INVENTION

The present invention relates to a high-strength steel sheet that is suitable for cold press forming and used in, for example, automobiles and household electrical appliances through a cold press forming process, a member obtained using the high-strength steel sheet as a steel material, and methods for manufacturing the same.

BACKGROUND OF THE INVENTION

In recent years, with an increasing demand for reductions in the weights of automobile bodies, there have been advances in the application of high-strength steel sheets having a tensile strength TS (hereinafter, may be simply referred to as TS alone) of 1,320 to 1,470 MPa-grade to vehicle frame parts, such as center pillar R/F (reinforcements), bumpers, and impact beam parts. From the viewpoint of further reducing the weights, studies on increasing the strength to 1.8 GPa-grade or higher strength are also being started. Hitherto, studies have been actively conducted on an increase in the strength by hot pressing, which includes pressing at a high temperature; however, recently, the application of high-strength steels in cold pressing has been studied again from the viewpoints of cost and productivity.

However, in the case where a high-strength steel sheet having a TS of 1,470 MPa-grade or higher is formed by cold pressing, a decrease in ductility tends to cause cracking while pressing, and thus such a high-strength steel sheet is applied to only parts having relatively simple shapes. Therefore, high-strength steel sheets are required to have formability higher than that in the related art. Moreover, in the case where a high-strength steel sheet having a TS of 1,470 MPa-grade or higher is formed into a part by cold pressing, a delayed fracture becomes significant as a result of an increase in residual stress inside the part and a deterioration of delayed fracture resistance of the steel material itself. The delayed fracture is a phenomenon that occurs as follows: when a part is placed in a hydrogen entry environment while a high stress is applied to the part, hydrogen enters the steel sheet and reduces interatomic bonding forces or causes local deformation, resulting in the formation of microcracks, and the microcracks propagate, resulting in a fracture.

Hitherto, TRIP steel containing retained austenite dispersed in the microstructures of steel sheets has been developed as a technique for improving ductility of steel sheets.

For example, Patent Literature 1 discloses a high-strength steel sheet having excellent workability, the high-strength steel sheet containing specified alloy components and satisfying the following: an area fraction of martensite with respect to the entire microstructure of the steel sheet is 10% or more and 90% or less, an amount of retained austenite is 5% or more and 50% or less, an area fraction of bainitic ferrite in upper bainite with respect to the entire microstructure of the steel sheet is 5% or more, the total of the area fraction of martensite with respect to the entire microstructure of the steel sheet, the amount of retained austenite, and the area fraction of bainitic ferrite in upper bainite with respect to the entire microstructure of the steel sheet is 60% or more, and an area fraction of polygonal ferrite with respect to the entire microstructure of the steel sheet is 10% or less (including 0%).

Patent Literature 2 discloses a high-strength steel sheet in which fine retained austenite is dispersed in the steel microstructure to achieve excellent ductility.

Patent Literature 3 discloses a technique for improving hydrogen embrittlement resistance of a TRIP steel sheet containing retained austenite by appropriately controlling quenching conditions and holding conditions after quenching to suppress the amount of fresh martensite to 5% by area or less.

Patent Literature 4 discloses a high-strength steel sheet having excellent formability.

Patent Literature 5 discloses a high-strength steel sheet that has a steel microstructure including a main phase composed of bainite and tempered martensite and that is excellent in steel sheet shape.

Patent Literature 6 discloses a high-strength steel sheet having both high ductility and excellent stretch flangeability.

PATENT LITERATURE

PTL 1: Japanese Unexamined Patent Application Publication No. 2010-65272
PTL 2: Japanese Patent No. 6540162
PTL 3: Japanese Patent No. 5412182
PTL 4: Japanese Patent No. 6288394
PTL 5: Japanese Patent No. 6291289
PTL 6: International Publication No. 2020/080402

SUMMARY OF THE INVENTION

However, in the technique of Patent Literature 1, tempering is not performed after quenching, and the microstructure of the steel sheet contains fresh martensite. Fresh martensite acts as the origin of a delayed fracture and may deteriorate delayed fracture resistance. Since the cooling rate is low, and self-tempered martensite is contained, it may be impossible to achieve a strength of TS: 1,470 MPa-grade. In addition, carbides in self-tempered martensite may be coarsened, resulting in a deterioration of delayed fracture resistance.

In each of the techniques of Patent Literatures 2 to 4, the tempering temperature of martensite is high, and it may be impossible to achieve a strength of TS: 1,470 MPa-grade. In addition, carbides in tempered martensite may be coarsened, resulting in a deterioration of delayed fracture resistance. In the technique of Patent Literature 5, the amount of C is low, and it may be impossible to achieve a strength of TS: 1,470 MPa-grade. In addition, ductility may also deteriorate due to a low average amount of C in retained austenite. In the technique of Patent Literature 6, the cooling rate after bainite is obtained is about 30° C./s, martensite is self-tempered during cooling, and, furthermore, carbides are coarsened by reheating and fine carbides are not obtained, which may deteriorate delayed fracture resistance.

Aspects of the present invention have been made in order to solve the problems described above, and an object according to aspects of the present invention is to provide a steel sheet and a member that have a tensile strength of 1,470 MPa or more (TS≥1,470 MPa) and that have excellent formability and excellent delayed fracture resistance, and methods for manufacturing the same.

Herein, the tensile strength refers to a tensile strength TS determined by cutting out a JIS No. 5 test piece for tensile test such that a rolling direction is the longitudinal direction, and subjecting the test piece to a tensile test in accordance with JIS 22241.

The phrase "having excellent formability" means that an elongation E1 determined by cutting out a JIS No. 5 test piece for tensile test such that a rolling direction is the longitudinal direction, and subjecting the test piece to a tensile test in accordance with JIS 22241 is 11% or more.

The phrase "having excellent delayed fracture resistance" means that no fracture is observed by the following evaluation.

(1) A strip test specimen is taken from a steel sheet at a position ¼ of the width of the coil so as to have a size of 30 mm in a rolling direction and a size of 100 mm in a direction perpendicular to the rolling direction.

(2) Edge surfaces of the test specimen having a length of 100 mm are formed by shearing. The test specimen is subjected to bending directly subsequent to shearing (without being subjected to machining to remove burrs) such that the burrs are located on the outer peripheral side of bending. The test specimen is fixed with bolts so as to maintain the shape of the test specimen during the bend forming.

In the shearing, the clearance is set to 15%, and the rake angle is set to 0 degree.

The bending is performed with a bend radius that satisfies R/t=4, where R represents a tip bend radius and t represents a sheet thickness (for example, when the sheet thickness t is 2.0 mm, the bend forming is performed with a punch having a punch tip radius of 8.0 mm) such that the inside angle of the tip is 90 degrees (V-bend).

The punch used is a U-shaped punch having a tip with the above radius (a punch including a semicircular tip R portion and a body having a thickness of 2R). A die having a corner R of 30 mm is used.

The depth the punch is pressed against the steel sheet is adjusted to form the steel sheet such that the bending angle of the tip is 90 degrees (V-shape).

The test specimen is pinched and fastened using a hydraulic jack such that the distance between flange ends of straight portions of the test specimen having been subjected to the bend forming is equal to that of the test specimen during the bend forming (such that a gap between the straight portions due to springback is cancelled out) and then fastened with bolts in this state.

The bolts are fixed so as to penetrate through holes having an elliptical shape (minor axis: 10 mm, major axis: 15 mm) and formed in advance in the strip test specimen at positions 10 mm inside from the respective short-side edges.

(3) The resulting test specimen fastened with the bolts is immersed in one liter or more per test specimen of hydrochloric acid (an aqueous hydrogen chloride solution) having a pH of 3, and a test is performed at an aqueous solution temperature of 25° C. while the pH is controlled to be constant.

The presence or absence of microcracks (initial state of delayed fracture) that can be visually observed (having a length of 1 mm or more) is constantly examined visually or using a camera. The time taken from the start of the immersion until the start of the formation of microcracks is measured as a delayed-fracture time.

(4) The test specimen is determined as "no fracture" when a fracture does not occur even after a lapse of $10^{(-0.0055\times(TS-1760)+0.3)}$ hours (10 to the power of (−0.0055×(TS−1760)+0.3) hours) since the start of the immersion.

To solve the foregoing problems, the inventors of the present invention have conducted intensive studies and have obtained the following findings.

i) It was found that a high-strength steel sheet having excellent formability and a tensile strength of 1,470 MPa or more (TS≥1,470 MPa) was obtained by utilizing tempered martensite to increase the strength, and by utilizing bainite transformation at a high C content of 0.20% by mass or more to reliably form retained austenite.

ii) It was found that delayed fracture resistance could be improved in a high-strength steel sheet with TS≥1,470 MPa by inhibiting the coarsening of carbides in tempered martensite.

iii) It was found that in order to appropriately control the particle sizes of carbides, the C, Si, and Mn contents and the cooling rate and the tempering temperature after bainite transformation need to be optimized.

Aspects of the present invention have been made on the basis of the above findings. Specifically, the aspects of the present invention include the following.

[1] A steel sheet having a chemical composition containing, by mass %,

C: 0.20% or more and 0.40% or less,
Si: more than 1.0% and 3.0% or less,
Mn: 1.5% or more and 3.5% or less,
P: 0.002% or more and 0.010% or less,
S: 0.0002% or more and 0.0020% or less,
sol. Al: 0.40% or less (not including 0%), and
N: 0.0100% or less, with the balance being Fe and incidental impurities; and a steel microstructure containing, in area fraction, tempered martensite: 45% or more and 83% or less, bainite: 15% or more and 53% or less, and retained austenite: 2% or more, wherein carbides in the tempered martensite have an average particle size of 0.40 μm or less, an average amount of C in the retained austenite is 0.5% by mass or more, and a tensile strength is 1,470 MPa or more.

[2] The steel sheet according to [1] above, wherein a hardness difference in microhardness between the bainite and the tempered martensite is 1.5 GPa or more.

[3] The steel sheet according to [1] or [2] above, wherein the chemical composition further contains, by mass %, one or two or more selected from:

Nb: 0.1% or less,
Ti: 0.10% or less,
B: 0.0050% or less,
Cu: 1% or less, and
Ni: 1% or less.

[4] The steel sheet according to any one of [1] to [3] above, wherein the chemical composition further contains, by mass %, one or two or more selected from:

Cr: 1.0% or less,
Mo: less than 0.3%,
V: 0.45% or less,
Zr: 0.2% or less, and
W: 0.2% or less.

[5] The steel sheet according to any one of [1] to [4] above, wherein the chemical composition further contains, by mass %, one or two selected from:

Sb: 0.1% or less, and
Sn: 0.1% or less.

[6] The steel sheet according to any one of [1] to [5] above, wherein the chemical composition further contains, by mass %, one or two or more selected from:

Ca: 0.0050% or less,

Mg: 0.01% or less, and

REM: 0.01% or less.

[7] The steel sheet according to any one of [1] to [6] above, having a coated layer on a surface of the steel sheet.

[8] A member obtained by subjecting the steel sheet according to any one of [1] to [7] to at least one of forming and joining.

[9] A method for manufacturing a steel sheet, the method being a method for manufacturing the steel sheet according to any one of [1] to [6] above, the method including:

a hot rolling step of hot-rolling a steel slab to obtain a hot-rolled steel sheet;

a cold rolling step of, after the hot rolling step, cold-rolling the hot-rolled steel sheet to obtain a cold-rolled steel sheet;

a continuous annealing step of, after the cold rolling step, annealing the cold-rolled steel sheet at an annealing temperature equal to or higher than an $Ac_3$ temperature for a soaking time of 15 seconds or more, subsequently cooling the resulting steel sheet to a holding temperature of an Ms temperature or higher and 600° C. or lower at a first average cooling rate of 5° C./s or more, holding the steel sheet at the holding temperature for a holding time of 1 second or more and 1,000 seconds or less, and cooling the steel sheet to a finish cooling temperature of 150° C. or lower at a second average cooling rate of 100° C./s or more; and an overaging treatment step of, after the continuous annealing step, holding the steel sheet in a temperature range of 150° C. or higher and 250° C. or lower for 30 seconds or more and 1,500 seconds or less.

[10] The method for manufacturing a steel sheet according to [9] above, including, before or after the overaging treatment step, a coating step of subjecting a surface of the steel sheet to coating treatment.

[11] A method for manufacturing a member, the method having a step of subjecting a steel sheet manufactured by the method for manufacturing a steel sheet according to [9] or above to at least one of forming and joining.

According to aspects of the present invention, a high-strength steel sheet having excellent formability and excellent delayed fracture resistance is provided. This improvement in properties enables a high-strength steel sheet for cold press forming to be applied to parts that are difficult to form and contributes to improvements in the strengths of parts and reductions in the weights of the parts.

DETAILED DESCRIPTION OF EMBODIMENTS OF THE INVENTION

Embodiments of the present invention will be described below. The present invention is not limited to the following embodiments.

A steel sheet according to aspects of the present invention has a chemical composition containing, by mass %, C: 0.20% or more and 0.40% or less, Si: more than 1.0% and 3.0% or less, Mn: 1.5% or more and 3.5% or less, P: 0.002% or more and 0.010% or less, S: 0.0002% or more and 0.0020% or less, sol. Al: 0.40% or less (not including 0%), and N: 0.0100% or less, with the balance being Fe and incidental impurities; and a steel microstructure containing, in area fraction, tempered martensite: 45% or more and 83% or less, bainite: 15% or more and 53% or less, and retained austenite: 2% or more. Carbides in the tempered martensite have an average particle size of 0.40 μm or less, an average amount of C in the retained austenite is 0.5% by mass or more, and a tensile strength is 1,470 MPa or more.

Chemical Composition

First, the content of each component will be described. The symbol "%" representing the content of a component means "% by mass", unless otherwise mentioned.

C: 0.20% or More and 0.40% or Less

C is contained in order to increase the strength of tempered martensite or bainite to ensure TS≥1,470 MPa. C is contained in order to form fine carbides serving as hydrogen-trapping sites in tempered martensite or bainite. A C content of less than 0.20% results in a failure to achieve predetermined strength while maintaining excellent delayed fracture resistance. To achieve TS≥1,470 MPa while maintaining excellent delayed fracture resistance, the C content is 0.20% or more. On the other hand, a C content of more than 0.40% results in excessively high strength to make it difficult to obtain sufficient delayed fracture resistance. Accordingly, the C content is 0.20% or more and 0.40% or less. The C content is preferably 0.21% or more, more preferably 0.22% or more, still more preferably 0.24% or more. The C content is preferably 0.35% or less, more preferably 0.33% or less, still more preferably 0.30% or less.

Si: More than 1.0% and 3.0% or Less

Si is contained as a strengthening element through solid solution hardening and contained in order to improve delayed fracture resistance by suppressing the formation of film-like carbides when tempering is performed in a temperature range of 200° C. or higher. To provide the above effects, Si is contained in an amount of more than 1.0%. A Si content of 1.0% or less results in a deterioration of formability.

On the other hand, a Si content of more than 3.0% results in an increase in the amount of segregation of Si and deteriorates delayed fracture resistance. In addition, a significant increase in the rolling load during hot rolling and cold rolling is caused. Furthermore, a decrease in toughness is caused. Accordingly, the Si content is more than 1.0% and 3.0% or less. The Si content is preferably 1.1% or more, more preferably 1.2% or more. The Si content is preferably 2.8% or less, more preferably 2.6% or less.

Mn: 1.5% or More and 3.5% or Less

Mn is contained in order to improve the hardenability of steel to cause the total area fraction of tempered martensite and bainite to fall within a predetermined range. Mn is contained in order to immobilize S in steel in the form of MnS to reduce hot shortness. Mn is an element that particularly promotes the formation and coarsening of MnS at a central portion in the thickness direction, combines with particles of inclusions, such as $Al_2O_3$, (Nb, Ti) (C, N), TiN, and TiS, and precipitates. These can be avoided by controlling the segregation state of Mn. However, in view of stability of weldability, the upper limit of the Mn content is 3.5%. In addition, from the viewpoint of obtaining sufficient delayed fracture resistance, the upper limit of the Mn content is 3.5%. The Mn content is preferably 3.3% or less, more preferably 3.1% or less. On the other hand, a Mn content of less than 1.5% results in a significant decrease in strength because ferrite is formed during cooling before bainite transformation. Accordingly, the Mn content is 1.5% or more and 3.5% or less. The Mn content is preferably 1.6% or more, more preferably 1.7% or more, still more preferably 1.9% or more.

P: 0.002% or More and 0.010% or Less

P is an element that strengthens steel; however, a high P content significantly deteriorates delayed fracture resistance and spot weldability. Accordingly, the P content is 0.010% or less. From the above viewpoint, the P content is preferably 0.006% or less. On the other hand, the lower limit of the P content that is industrially feasible at present is 0.002%. Thus, the P content is 0.002% or more and 0.010% or less.

S: 0.0002% or More and 0.0020% or Less

S needs to be precisely controlled because S has a significant effect on delayed fracture resistance through the formation of, for example, MnS, TiS, and Ti(C, S). To reduce adverse effects of inclusion clusters, the S content needs to be at least 0.0020% or less. In order to improve delayed fracture resistance, the S content is preferably 0.0010% or less. On the other hand, the lower limit of the S content that is industrially feasible at present is 0.0002%. Thus, the S content is 0.0002% or more and 0.0020% or less.

Sol. Al: 0.40% or Less (not Including 0%)

Al is contained in order to perform sufficient deoxidization to reduce the amounts of inclusions in steel. To stably perform deoxidization, the sol. Al content is preferably 0.005% or more, more preferably 0.01% or more. On the other hand, a sol. Al content of more than 0.40% results in a deterioration of delayed fracture resistance because cementite formed during coiling is less likely to be dissolved during an annealing process. Accordingly, the sol. Al content is 0.40% or less, preferably 0.35% or less, more preferably 0.30% or less.

N: 0.0100% or Less

N is an element that forms inclusions of nitrides and carbonitrides, such as TiN, (Nb, Ti) (C, N), and AlN, in steel and deteriorates delayed fracture resistance through the formation of these. These inclusions prevent a steel microstructure specified in accordance with aspects of the present invention from being obtained and adversely affects delayed fracture resistance. To reduce such adverse effects, the N content needs to be 0.0100% or less. The N content is preferably 0.0055% or less. On the other hand, the lower limit of the N content that is industrially feasible at present is 0.0006%.

The balance other than the above has a chemical composition containing Fe (iron) and incidental impurities. Here, the steel sheet according to aspects of the present invention preferably has a chemical composition containing the above basic components with the balance being Fe and incidental impurities. Note that the following optional elements may be contained. When any of the following optional elements is contained in an amount less than the appropriate lower limit, such an optional element can be assumed to be contained as an incidental impurity.

Nb: 0.1% or Less

Nb contributes to an increase in strength through refinement of the internal structures of martensite and bainite and improves delayed fracture resistance as described above. From these viewpoints, Nb is preferably contained in an amount of 0.001% or more, more preferably 0.005% or more. On the other hand, a Nb content of more than 0.1% may result in the formation of a large number of Nb-based inclusion clusters distributed in a sequence of dots in the rolling direction and adversely affect delayed fracture resistance. To reduce such an adverse effect, when Nb is contained, the Nb content is 0.1% or less. The Nb content is preferably 0.08% or less, more preferably 0.06% or less.

Ti: 0.10% or Less

Ti contributes to an increase in strength through refinement of the internal structures of martensite and bainite. Ti improves delayed fracture resistance through the formation of fine Ti-based carbides and carbonitrides serving as hydrogen-trapping sites. Furthermore, Ti improves castability. From these viewpoints, the Ti content is preferably 0.002% or more, and Ti is more preferably contained in an amount of 0.005% or more. On the other hand, an excessively high Ti content may result in the formation of a large number of Ti-based inclusion particle clusters distributed in a sequence of dots in the rolling direction and adversely affect delayed fracture resistance. To reduce such an adverse effect, when Ti is contained, the Ti content is 0.10% or less. The Ti content is preferably 0.07% or less, more preferably 0.05% or less.

B: 0.0050% or Less

B is an element that improves the hardenability of steel and has an advantage of forming martensite and bainite with predetermined area fractions even at a low Mn content. To provide these effects of B, the B content is preferably 0.0001% or more, more preferably 0.0005% or more. In order to immobilize N, B is preferably contained in combination with 0.002% or more of Ti. On the other hand, a B content of more than 0.0050% results in not only saturation of the effects but also a decrease in the dissolution rate of cementite during annealing to cause undissolved cementite to remain, resulting in a deterioration of delayed fracture resistance.

Accordingly, when B is contained, the B content is 0.0050% or less, preferably less than 0.0035%.

Cu: 1% or Less

Cu improves corrosion resistance in a usage environment of automobiles. When Cu is contained, the following effect is obtained: corrosion products of Cu cover the surface of the steel sheet to inhibit the hydrogen entry into the steel sheet. Cu is an element that is unintentionally incorporated when scrap is utilized as a raw material. Permitting the unintentional incorporation of Cu enables recycle materials to be reused as raw materials, thus reducing the manufacturing cost. From the above viewpoints, Cu is preferably contained in an amount of 0.01% or more. Furthermore, from the viewpoint of improving delayed fracture resistance, Cu is preferably contained in an amount of 0.05% or more. However, a Cu content of more than 1% may result in surface defects. Accordingly, when Cu is contained, the Cu content is 1% or less. The Cu content is preferably 0.40% or less, more preferably 0.30% or less.

Ni: 1% or Less

Ni is also an element that has an effect of improving corrosion resistance. In addition, Ni has an effect of reducing the surface defects that are likely to be formed when Cu is contained. Accordingly, from the above viewpoints, Ni is preferably contained in an amount of 0.01% or more, more preferably 0.02% or more. However, a Ni content of more than 1% results in nonuniform scale formation in a heating furnace to cause surface defects and results in a significant increase in cost. Accordingly, when Ni is contained, the Ni content is 1% or less. The Ni content is preferably 0.20% or less, more preferably 0.10% or less.

Cr: 1.0% or Less

Cr can be added to obtain an effect of improving the hardenability of steel. To achieve the effect, Cr is preferably contained in an amount of 0.01% or more, more preferably 0.02% or more. However, a Cr content of more than 1.0% results in a decrease in the dissolution rate of cementite during annealing to cause undissolved cementite to remain, resulting in a deterioration of delayed fracture resistance. In addition, a deterioration of pitting corrosion resistance is also caused. Furthermore, a deterioration of chemical convertibility is also caused. Accordingly, when Cr is contained, the Cr content is 1.0% or less. Delayed fracture resistance, pitting corrosion resistance, and chemical convertibility each tend to start deteriorating at a Cr content of more than 0.8%. Thus, in order to prevent deteriorations of these properties, the Cr content is preferably 0.8% or less. The Cr content is more preferably 0.6% or less, still more preferably 0.4% or less.

Mo: Less than 0.3%

Mo can be added in order to obtain an effect of improving the hardenability of steel, an effect of forming fine carbides that contain Mo and serve as hydrogen-trapping sites, and an effect of improving delayed fracture resistance by refining martensite. When Nb and Ti are added in large amounts, coarse precipitates thereof are formed, and delayed fracture resistance rather deteriorates. However, the solubility limit of Mo is higher than those of Nb and Ti. When Mo is added in combination with Nb and Ti, fine complex precipitates of Nb, Ti, and Mo are formed to refine the microstructure. Accordingly, the addition of Mo in combination with small amounts of Nb and Ti enables dispersion of a large number of fine carbides while refining the microstructure without leaving coarse precipitates, thus improving delayed fracture resistance. To provide this effect, Mo is preferably contained in an amount of 0.01% or more, more preferably 0.02% or more. However, a Mo content of 0.3% or more deteriorates chemical convertibility. Accordingly, when Mo is contained, the Mo content is less than 0.3%. The Mo content is preferably 0.2% or less, more preferably 0.1% or less.

V: 0.45% or Less

V can be added in order to obtain an effect of improving the hardenability of steel, an effect of forming fine carbides that contain V and serve as hydrogen-trapping sites, and an effect of improving delayed fracture resistance by refining martensite. To provide these effects, the V content is preferably 0.003% or more, more preferably 0.005% or more. However, a V content of more than 0.45% significantly deteriorates castability. Accordingly, when V is contained, the V content is 0.45% or less. The V content is preferably 0.2% or less, more preferably 0.1% or less.

Zr: 0.2% or Less

Zr contributes to an increase in strength and improves delayed fracture resistance through a reduction in size of prior-γ grains and the resulting reductions in sizes of, for example, blocks and Bain grains, which are internal structural units of martensite and bainite. Furthermore, Zr increases strength and improves delayed fracture resistance through the formation of fine Zr-based carbides and carbonitrides serving as hydrogen-trapping sites. Zr also improves castability. From the above viewpoints, the Zr content is preferably 0.001% or more, more preferably 0.005% or more. However, the addition of a large amount of Zr results in an increase in coarse ZrN- and ZrS-based precipitates that remain undissolved during slab heating in the hot rolling step, thereby deteriorating delayed fracture resistance. Accordingly, when Zr is contained, the Zr content is 0.2% or less. The Zr content is preferably 0.05% or less, more preferably 0.01% or less.

W: 0.2% or Less

W contributes to an increase in strength and an improvement in delayed fracture resistance through the formation of fine W-based carbides and carbonitrides serving as hydrogen-trapping sites. From the above viewpoints, W is preferably contained in an amount of 0.005% or more, more preferably 0.01% or more. However, a W content of more than 0.2% results in an increase in coarse precipitates that remain undissolved during slab heating in the hot rolling step, thereby deteriorating delayed fracture resistance. Therefore, when W is contained, the W content is 0.2% or less. The W content is preferably 0.1% or less, more preferably 0.05% or less.

Sb: 0.1% or Less

Sb suppresses oxidation and nitridation of the surface layer to thereby suppress decreases in C and B. The suppression of the decreases in C and B inhibits the formation of ferrite in the surface layer to contribute to an increase in strength and an improvement in delayed fracture resistance. From the above viewpoints, the Sb content is preferably 0.002% or more, more preferably 0.005% or more. However, an Sb content of more than 0.1% results in a deterioration of castability and results in segregation of Sb at prior-γ grain boundaries, thereby deteriorating delayed fracture resistance. Therefore, when Sb is contained, the Sb content is 0.1% or less. The Sb content is preferably 0.06% or less, more preferably 0.04% or less.

Sn: 0.1% or Less

Sn suppresses oxidation and nitridation of the surface layer to thereby suppress decreases in the C and B contents in the surface layer. The suppression of the decreases in C and B inhibits the formation of ferrite in the surface layer to contribute to an increase in strength and an improvement in delayed fracture resistance. From the above viewpoints, the Sn content is preferably 0.002% or more, more preferably 0.004% or more. However, a Sn content of more than 0.1% results in a deterioration of castability and results in segregation of Sn at prior-γ grain boundaries, thereby deteriorating delayed fracture resistance. Therefore, when Sn is contained, the Sn content is 0.1% or less. The Sn content is preferably 0.04% or less, more preferably 0.02% or less.

Ca: 0.0050% or Less

Ca immobilizes S in the form of CaS to improve delayed fracture resistance. To provide this effect, Ca is preferably contained in an amount of 0.0001% or more. The Ca content is more preferably 0.0005% or more. However, a Ca content of more than 0.0050% results in deteriorations of surface quality and bendability. Therefore, when Ca is contained, the Ca content is 0.0050% or less.

Mg: 0.01% or Less

Mg immobilizes 0 in the form of MgO to improve delayed fracture resistance. To provide this effect, Mg is preferably contained in an amount of 0.0001% or more. However, a Mg content of more than 0.01% results in deteriorations of surface quality and bendability. Accordingly, when Mg is contained, the Mg content is 0.01% or less. The Mg content is preferably 0.005% or less, more preferably 0.001% or less.

REM: 0.01% or Less

A REM reduces the size of inclusions and reduces fracture origins to thereby improve bendability and delayed fracture resistance. To provide this effect, a REM is preferably contained in an amount of 0.0001% or more. However, a REM content of more than 0.01% results in, on the contrary, the coarsening of inclusions and deteriorates bendability and delayed fracture resistance. Therefore, when a REM is contained, the REM content is 0.01% or less. The REM content is preferably 0.004% or less, more preferably 0.002% or less.

Steel Microstructure

A steel microstructure of the steel sheet according to aspects of the present invention has the following features.

(Feature 1) In area fraction, 45% or more and 83% or less of tempered martensite, 15% or more and 53% or less of bainite, and 2% or more of retained austenite are contained.

(Feature 2) An average amount of C in retained austenite is 0.5% by mass or more.

(Feature 3) Carbides in tempered martensite have an average particle size of 0.40 μm or less.

(Feature 4 (suitable requirement)) A hardness difference in microhardness between bainite and tempered martensite is 1.5 GPa or more.

(Feature 1) In area fraction, 45% or more and 83% or less of tempered martensite, 15% or more and 53% or less of bainite, and 2% or more of retained austenite are contained. To obtain high strength of TS≥1,470 MPa, the area fraction of tempered martensite in the steel microstructure is 45% or more. When the area fraction of tempered martensite is less than this, the amounts of bainite and retained austenite increase, resulting in a decrease in strength. To obtain higher TS, the area fraction of tempered martensite is preferably 50% or more, more preferably 55% or more. On the other hand, when the area fraction of tempered martensite is more than 83%, the amounts of bainite and retained austenite are insufficient, resulting in a deterioration of formability. Therefore, the area fraction of tempered martensite is 83% or less. To obtain higher formability, the area fraction of tempered martensite is preferably 80% or less, more preferably 75% or less.

Bainite is a microstructure excellent in strength and formability. To obtain high formability, the area fraction of bainite is 15% or more. When the area fraction of bainite is less than this, the amount of tempered martensite increases, resulting in a deterioration of formability. With the formation of bainite, the amount of retained austenite increases. Thus, the area fraction of bainite is preferably 20% or more, more preferably 25% or more. On the other hand, when the area fraction of bainite is more than 53%, the amount of tempered martensite decreases, resulting in a decrease in strength. Accordingly, the area fraction of bainite is 53% or less, and to obtain higher strength, preferably 50% or less, more preferably 45% or less.

Retained austenite enhances the balance between strength and ductility. When the area fraction of retained austenite is less than 2%, a good balance is not achieved between strength and ductility. Thus, the area fraction of retained austenite is 2% or more. To obtain a better balance between strength and ductility, the area fraction of retained austenite is preferably 3% or more, more preferably 4% or more. Although the upper limit is not specified, when the amount of retained austenite is excessively large, the retained austenite is transformed into martensite during forming, resulting in an increase in the origins of delayed fractures. The area fraction of retained austenite is preferably 20% or less, more preferably 15% or less. In accordance with aspects of the present invention, retained austenite satisfies (Feature 2) of the following conditions.

The presence of ferrite decreases the strength because ferrite is very soft. In addition, because of a large difference in hardness from tempered martensite, during deformation, strain may concentrate at the interface between martensite and ferrite and acts as a fracture origin, resulting in deterioration of delayed fracture resistance. Therefore, the area fraction of ferrite is preferably 3% or less, more preferably 0%. Pearlite is a microstructure composed of lamellar ferrite and cementite. The formation of pearlite decreases the amount of C in martensite, and the strength may decrease. The area fraction of pearlite is preferably 3% or less, more preferably 0%. In accordance with aspects of the present invention, the total area fraction of ferrite and pearlite is preferably 6% or less, more preferably 2%, still more preferably 0%.

(Feature 2) An average amount of C in retained austenite is 0.5% by mass or more.

In accordance with aspects of the present invention, an average amount of C in retained austenite is 0.5% by mass or more. As the average amount of C in retained austenite increases, the retained austenite has higher stability, and a better balance between strength and ductility is achieved. When the average amount of C in retained austenite is less than 0.5% by mass, a good balance between strength and ductility is not achieved. Furthermore, because of low stability, the amount of retained austenite that is transformed into martensite during forming increases, such martensite acts as the origin of a delayed fracture, and delayed fracture resistance may be deteriorated. Accordingly, the average amount of C in retained austenite is 0.5% by mass or more, preferably 0.6% by mass or more, more preferably 0.7% by mass or more. The upper limit of the average amount of C in retained austenite is not specified. However, when the average amount of C in retained austenite is excessively high, the transformation of retained austenite to martensite resulting from tensile deformation does not proceed sufficiently, and sufficient work hardening ability is not obtained. The average amount of C in retained austenite is preferably 2.0% by mass or less, more preferably 1.8% by mass or less.

(Feature 3) Carbides in tempered martensite have an average particle size of 0.40 μm or less.

In the steel microstructure according to aspects of the present invention, the feature 3 is important for improving delayed fracture resistance of the steel sheet. In accordance with aspects of the present invention, carbides in tempered martensite have an average particle size of 0.40 μm or less. When the average particle size of the carbides is 0.40 μm or less, delayed fracture resistance can be improved. When the carbides are further coarsened, delayed fracture resistance may be deteriorated. The average particle size is preferably 0.38 μm or less, more preferably 0.36 μm or less. The lower limit is not particularly limited; however, to improve toughness, the average particle size of the carbides is preferably 0.001 μm or more, more preferably 0.01 μm or more.

(Feature 4 (suitable requirement)) A hardness difference in microhardness between bainite and tempered martensite is 1.5 GPa or more.

In the steel microstructure according to aspects of the present invention, the feature 4 is important for obtaining high formability. Presumably, as the difference in hardness between bainite and tempered martensite increases, a larger plastic deformation gradient is formed during plastic deformation to increase the density of geometrically necessary (GN) dislocations accumulated in bainite. Therefore, as the difference in hardness increases, the amount of work hardening due to GN dislocations increases, and higher elongation is obtained. Thus, the difference in hardness between bainite and tempered martensite is preferably 1.5 GPa or more. The upper limit is not particularly limited. However, when the difference in hardness is excessively large, stretch flangeability tends to deteriorate. Accordingly, the difference in hardness between bainite and tempered martensite is preferably 15 GPa or less, more preferably 13 GPa or less.

(Conditions for measurement of microstructure) The metallic microstructure is quantified by polishing an L-section (a section parallel to the rolling direction and perpendicular to a steel sheet surface) of the steel sheet, then etching the section in nital, observing the section at a ¼ thickness position from the steel sheet surface with a SEM at a magnification of 2,000× in four fields of view, and subjecting a captured microstructure image to image analysis. Here, tempered martensite is a microstructure that appears gray in SEM. On the other hand, bainite and ferrite are regions that appear a black contrast in SEM. Although tempered martensite and bainite include trace amounts of carbides, nitrides, sulfides, and oxides inside thereof, it is difficult to exclude them, and thus area fractions of regions that include these are measured as the area fractions of tempered martensite and bainite. Ferrite is a microstructure that is formed by transformation from austenite at a relatively high temperature and composed of grains with a bcc lattice. Bainite is a microstructure that is formed from austenite at a relatively low temperature (equal to or higher than the martensite transformation temperature) and that contains spherical carbides dispersed in lath- or plate-shaped ferrite. Pearlite is a microstructure in which cementite is precipitated in ferrite in a lamellar form.

Regarding the measurement of retained austenite, a surface layer of the steel sheet is subjected to chemical polishing with oxalic acid to a depth of 200 μm, and the surface of the sheet is analyzed by an X-ray diffraction intensity method. Calculations are made using integral intensities of peaks of (200)α, (211)α, (220)α, (200)γ, (220)γ, and (311)γ diffraction planes measured with Mo—$K_\alpha$ radiation.

The area fraction of retained austenite determined as described above is subtracted from 100%, and the residual area fraction is distributed in the proportion of tempered martensite, bainite, ferrite, and pearlite determined by the observation of the microstructure image obtained with the SEM using a point counting method. Thus, the area fractions of tempered martensite, bainite, ferrite, pearlite, and retained austenite can be specified.

The average amount of C in retained austenite is determined by calculating a lattice constant ($\alpha_\gamma$) of γ from a {220} peak angle of γ using a Co—$K_\alpha$ radiation source, and substituting the amounts of alloying elements contained into the following formula.

$$\alpha_\gamma=3.578+0.00095(\%\ Mn)+0.022(\%\ N)+0.0056(\%\ Al)+0.033(\%\ C)$$

In the formula, (% Mn), (% N), and (% Al) are the contents (% by mass) of Mn, N, and Al, respectively. (% C) is the average amount of C (% by mass) in retained austenite.

In quantification of the sizes of carbides in tempered martensite, an L-section (a vertical section parallel to the rolling direction) of the steel sheet is polished and then etched in nital, and the section is observed at a ¼ thickness position from the steel sheet surface with a SEM at a magnification of 10,000× in two fields of view. In the observation image, white particles that are finely dispersed in the tempered martensite microstructure are regarded as carbides and appropriately enlarged, and the lengths of the major axes of the carbides are measured. The carbides are assumed to be elliptical or acicular to specify the major axes. Specifically, in three martensite blocks, the major axes of five carbides are measured from each of the three martensite blocks and averaged. The average is defined as the average particle size of carbides in tempered martensite.

The microhardness is measured using nanoindentation at a load of 100 μN at a ¼ thickness position on a polished sheet surface. The measurement is performed at five points in each of the bainite and tempered martensite microstructures, and the average values are determined. The difference thereof is defined as the hardness difference. The maximum load is 500 μN, and a Berkovich indenter with an angle between opposite edges of 115 degrees is used.

The steel sheet according to aspects of the present invention may have a coated layer on a surface thereof. The type of coated layer is not particularly limited and may be either a Zn-coated layer (zinc-coated layer) or a coated layer of a metal other than Zn. The coated layer may contain a component other than a main component, main component being Zn or the like. The zinc-coated layer is, for example, a hot-dip galvanized layer or an electrogalvanized layer.

Next, a method for manufacturing a steel sheet according to aspects of the present invention will be described. The method for manufacturing a steel sheet according to aspects of the present invention includes a hot rolling step of hot-rolling a steel slab having the above chemical composition to obtain a hot-rolled steel sheet; a cold rolling step of, after the hot rolling step, cold-rolling the hot-rolled steel sheet to obtain a cold-rolled steel sheet; a continuous annealing step of, after the cold rolling step, annealing the cold-rolled steel sheet at an annealing temperature equal to or higher than an $Ac_3$ temperature for a soaking time of 15 seconds or more, subsequently cooling the resulting steel sheet to a holding temperature of an Ms temperature or higher and 600° C. or lower at a first average cooling rate of 5° C./s or more, holding the steel sheet at the holding temperature for a holding time of 1 second or more and 1,000 seconds or less, and cooling the steel sheet to a finish cooling temperature of 150° C. or lower at a second average cooling rate of 100° C./s or more; and an overaging treatment step of, after the continuous annealing step, holding the steel sheet in a temperature range of 150° C. or higher and 250° C. or lower for 30 seconds or more and 1,500 seconds or less.

Hot Rolling Step

Examples of a method for hot-rolling a steel slab include a method in which a slab is heated and then rolled, a method in which a slab after continuous casting is subjected to direct rolling without being heated, and a method in which a slab after continuous casting is subjected to heat treatment for a short time and then rolling. In the hot rolling, the average heating rate during slab heating may be 5 to 15° C./min, the finish rolling temperature FT may be 840° C. to 950° C., and the coiling temperature CT may be 400° C. to 700° C., as in the usual method.

In order to remove primary scale and secondary scale formed on the surface of the steel sheet, descaling may be performed as appropriate. It is preferable to sufficiently pickle the hot rolled coil before cold rolling to reduce the amount of remaining scale. From the viewpoint of reducing the load required for cold rolling, the hot-rolled steel sheet may be subjected to annealing, as needed.

Cold Rolling Step

When the rolling reduction in the cold rolling (cold rolling reduction) is 40% or more, the recrystallization behavior and the orientation of the texture in the subsequent continuous annealing can be stabilized. When the rolling reduction is less than 40%, some of austenite grains during annealing may be coarsened, which may result in a decrease in strength.

Continuous Annealing Step

The steel sheet after cold rolling is subjected to annealing and tempering treatment in a continuous annealing line (CAL).

In accordance with aspects of the present invention, to obtain predetermined tempered martensite and bainite, the annealing temperature is the $Ac_3$ temperature or higher, and the soaking time is 15 seconds or more. When the annealing temperature is lower than the $Ac_3$ temperature or the soaking time is less than 15 seconds, austenite (γ) is not sufficiently formed during annealing. Thus, in the final product, predetermined tempered martensite and/or bainite is not obtained and a tensile strength of 1,470 MPa or more is not achieved.

The upper limits of the annealing temperature and the soaking time are not particularly limited. However, when the annealing temperature or the soaking time is at a certain level or higher, the austenite grain size may be coarsened, and delayed fracture resistance may deteriorate. Accordingly, the annealing temperature is preferably 950° C. or lower, and the soaking time is preferably 900 seconds or less.

Subsequently, to reduce the amount of ferrite, the resulting steel sheet needs to be cooled to a holding temperature of the Ms temperature or higher and 600° C. or lower at a first average cooling rate of 5° C./s or more. A first average cooling rate of less than 5° C./s results in the formation of a large amount of ferrite and the concentration of carbon in γ to lower the Ms temperature, thus increasing the amount of martensite not subjected to tempering treatment (fresh martensite). Accordingly, the first average cooling rate is preferably 7° C./s or more, more preferably 10° C./s or more.

Subsequently, to obtain predetermined bainite, isothermal holding at a holding temperature of the Ms temperature or higher and 600° C. or lower is necessary for 1 second or more and 1,000 seconds or less. A holding temperature of higher than 600° C. results in the formation of a large amount of ferrite. On the other hand, a holding temperature of lower than the Ms temperature results in the formation of martensite tempered at a temperature higher than 250° C. (self-tempered martensite) during isothermal holding and significant coarsening of carbides in grains and at block grain boundaries, which may result in a deterioration of delayed fracture resistance. The lower the holding temperature, the more likely retained austenite is obtained. Thus, the holding temperature is preferably 550° C. or lower, more preferably 500° C. or lower.

When the holding time is shorter than 1 second, the amounts of bainite and retained austenite are small, resulting in a problem of a deterioration of formability. The holding time is preferably 10 seconds or more, more preferably 50 seconds or more. On the other hand, when the holding time is longer than 1,000 seconds, the amount of tempered martensite decreases, resulting in a problem that a tensile strength of 1,470 MPa or more is not achieved. The holding time is preferably 500 seconds or less, more preferably 300 seconds or less.

Subsequently, to obtain tempered martensite excellent in delayed fracture resistance, the steel sheet needs to be cooled to a finish cooling temperature of 150° C. or lower at a second average cooling rate of 100° C./s or more. When the second average cooling rate is less than 100° C./s or the finish cooling temperature exceeds 150° C., self-tempered martensite containing coarse carbides in grains is formed, and delayed fracture resistance may deteriorate.

Overaging Treatment Step

Carbides distributed inside tempered martensite are carbides formed during holding in a low temperature range after quenching and need to be appropriately controlled in order to ensure delayed fracture resistance and TS≥1,470 MPa. Specifically, the temperature at which the steel sheet is reheated and held after quenching to 150° C. or lower needs to be 150° C. or higher and 250° C. or lower, and the holding time needs to be controlled to 30 seconds or more and 1,500 seconds or less.

When the temperature is lower than 150° C. or the holding time is less than 30 seconds, the carbide distribution density may be insufficient, and toughness may deteriorate. On the other hand, when the temperature exceeds 250° C. or the holding time exceeds 1,500 seconds, carbides in grains and at block grain boundaries may be significantly coarsened, and delayed fracture resistance may deteriorate.

Coating Treatment Step

Before or after the overaging treatment step, the surface of the resulting steel sheet may be subjected to coating treatment. The coating treatment provides a steel sheet having a coated layer on the surface thereof. The type of coating treatment is not particularly limited and may be either coating using a technique of providing coating with a spray or electroplated coating. In the case of performing coating treatment, when the skin pass rolling is performed, the skin pass rolling is performed after the coating treatment.

The $Ac_3$ temperature and the Ms temperature are calculated from the following formulae (1) and (2) described in "The Physical Metallurgy of Steels, William C. Leslie" (Maruzen Co., Ltd., issued in 1985, p. 273 and p. 231). Note that [M %] represents the content (% by mass) of each element M.

$$Ac_3(°\,C.)=910-203\times[C\,\%]^{1/2}+44.7\times[Si\,\%]-30\times[Mn\,\%]+700\times[P\,\%]+130\times[Al\,\%]-15.2\times[Ni\,\%]-11\times[Cr\,\%]-20\times[Cu\,\%]+31.5\times[Mo\,\%]+104\times[V\,\%]+400\times[Ti\,\%] \quad (1)$$

$$Ms(°\,C.)=561-474\times[Co]-33\times[Mn\,\%]-17\times[Ni\,\%]-17\times[Cr\,\%]-21\times[Mo\,\%] \quad (2)$$

The steel sheet according to aspects of the present invention obtained by the manufacturing method described above preferably has a thickness of 0.5 mm or more. The thickness of the steel sheet is preferably 2.5 mm or less.

Next, a member according to aspects of the present invention and a method for manufacturing the member will be described.

The member according to aspects of the present invention is a member obtained by subjecting the steel sheet according to aspects of the present invention to at least one of forming and joining. The method for manufacturing a member according to aspects of the present invention includes a step of subjecting a steel sheet manufactured by the method for manufacturing a steel sheet according to aspects of the present invention to at least one of forming and joining.

The steel sheet according to aspects of the present invention has a tensile strength of 1,470 MPa or more and has excellent formability and delayed fracture resistance. Accordingly, the member obtained using the steel sheet according to aspects of the present invention also has high strength and has higher formability and delayed fracture resistance than existing high-strength members. Use of the member according to aspects of the present invention enables weight reduction. Thus, the member according to aspects of the present invention is suitable for use in, for example, members with complicated shapes used in the field of automobiles, such as vehicle frame parts.

For the forming, typical processing methods, such as press forming, can be used without limitation. The joining processing methods are also not particularly limited, and for example, typical welding, such as spot welding, laser welding, and arc welding, riveting, and caulking can be used. The forming conditions and joining conditions are not particularly limited, and usual methods may be employed.

EXAMPLES

Example 1

Examples of the present invention will be described below.

Cold-rolled steel sheets having chemical compositions shown in Table 1 and having a thickness of 1.2 mm were subjected to heat treatment under the annealing conditions and overaging treatment conditions shown in Table 2.

The soaking time at the annealing temperature was 300 seconds. Regarding No. 19, after the overaging treatment, the steel sheet surface was subjected to coating treatment. The conditions for the coating treatment were those for electrogalvanizing.

The cold-rolled steel sheets were obtained by subjecting steel slabs having chemical compositions shown in Table 1 to hot rolling (average heating rate during heating: 10° C./min, finish rolling temperature FT: 900° C., and coiling temperature CT: 500° C.) and subsequent cold rolling (rolling reduction: 55%).

TABLE 1

| Steel | Chemical composition (mass %) | | | | | | | | Ms temperature | $Ac_3$ temperature | |
|---|---|---|---|---|---|---|---|---|---|---|---|
| No. | C | Si | Mn | P | S | sol.Al | N | others | (° C.) | (° C.) | Remarks |
| A | 0.21 | 1.5 | 2.2 | 0.006 | 0.0009 | 0.026 | 0.0029 | — | 389 | 826 | Conforming steel |
| B | 0.39 | 1.6 | 2.1 | 0.006 | 0.0010 | 0.044 | 0.0028 | — | 307 | 802 | Conforming steel |
| C | 0.26 | 1.1 | 2.0 | 0.005 | 0.0004 | 0.025 | 0.0050 | — | 372 | 802 | Conforming steel |
| D | 0.29 | 3.0 | 2.2 | 0.006 | 0.0014 | 0.038 | 0.0033 | — | 351 | 878 | Conforming steel |
| E | 0.27 | 1.2 | 1.6 | 0.007 | 0.0008 | 0.037 | 0.0045 | — | 380 | 820 | Conforming steel |
| F | 0.27 | 1.7 | 3.4 | 0.005 | 0.0019 | 0.021 | 0.0046 | — | 321 | 785 | Conforming steel |
| G | 0.30 | 1.2 | 1.9 | 0.009 | 0.0003 | 0.039 | 0.0051 | — | 356 | 807 | Conforming steel |
| H | 0.37 | 1.6 | 2.1 | 0.005 | 0.0019 | 0.000 | 0.0045 | — | 316 | 799 | Conforming steel |
| I | 0.21 | 1.2 | 1.9 | 0.006 | 0.0005 | 0.054 | 0.0041 | Cu: 0.12 | 399 | 822 | Conforming steel |
| J | 0.21 | 1.5 | 2.9 | 0.006 | 0.0006 | 0.041 | 0.0037 | Cu: 0.20, Nb: 0.010 | 366 | 803 | Conforming steel |
| K | 0.26 | 1.1 | 1.9 | 0.008 | 0.0008 | 0.036 | 0.0029 | Ti: 0.03, B: 0.0010, V: 0.003 | 375 | 821 | Conforming steel |
| L | 0.28 | 2.3 | 1.8 | 0.006 | 0.0010 | 0.040 | 0.0035 | Cr: 0.40, V: 0.005, Zr: 0.004 | 362 | 857 | Conforming steel |
| M | 0.27 | 2.7 | 2.1 | 0.005 | 0.0011 | 0.029 | 0.0046 | V: 0.050, W: 0.008 | 364 | 875 | Conforming steel |
| N | 0.25 | 1.3 | 1.9 | 0.006 | 0.0008 | 0.026 | 0.0040 | Ni: 0.02, Sb: 0.008 | 379 | 817 | Conforming steel |
| O | 0.26 | 1.5 | 2.8 | 0.007 | 0.0006 | 0.031 | 0.0030 | Sb: 0.010, Sn: 0.005 | 345 | 798 | Conforming steel |
| P | 0.31 | 1.8 | 2.1 | 0.006 | 0.0007 | 0.031 | 0.0023 | Ca: 0.0030, Mg: 0.0008 | 345 | 823 | Conforming steel |
| Q | 0.21 | 1.2 | 2.5 | 0.005 | 0.0005 | 0.035 | 0.0043 | Mg: 0.0005, REM: 0.0003 | 379 | 804 | Conforming steel |
| R | 0.28 | 2.1 | 2.3 | 0.004 | 0.0005 | 0.032 | 0.0039 | Mo: 0.02, Cr: 0.03, Sb: 0.010 | 351 | 835 | Conforming steel |
| S | 0.24 | 2.4 | 2.1 | 0.007 | 0.0010 | 0.041 | 0.0050 | — | 378 | 865 | Conforming steel |
| T | 0.24 | 1.8 | 2.4 | 0.006 | 0.0007 | 0.300 | 0.0048 | — | 368 | 862 | Conforming steel |
| U | 0.19 | 1.2 | 2.8 | 0.008 | 0.0010 | 0.032 | 0.0039 | — | 379 | 801 | Comparative steel |
| V | 0.42 | 1.9 | 1.9 | 0.008 | 0.0010 | 0.017 | 0.0052 | — | 299 | 814 | Comparative steel |
| W | 0.23 | 0.9 | 2.6 | 0.006 | 0.0012 | 0.052 | 0.0040 | — | 366 | 786 | Comparative steel |
| X | 0.21 | 3.1 | 2.7 | 0.008 | 0.0013 | 0.019 | 0.0037 | — | 372 | 883 | Comparative steel |
| Y | 0.23 | 1.7 | 1.4 | 0.009 | 0.0011 | 0.041 | 0.0034 | — | 406 | 858 | Comparative steel |
| Z | 0.26 | 1.2 | 3.6 | 0.006 | 0.0016 | 0.031 | 0.0034 | — | 319 | 760 | Comparative steel |
| AA | 0.25 | 1.1 | 1.6 | 0.011 | 0.0011 | 0.040 | 0.0040 | — | 390 | 823 | Comparative steel |
| AB | 0.28 | 1.6 | 2.1 | 0.007 | 0.0023 | 0.048 | 0.0052 | — | 359 | 822 | Comparative steel |

The balance other than the above is Fe and incidental impurities.

TABLE 2

| | | Annealing conditions | | | | | | | | Overaging treatment conditions | | |
|---|---|---|---|---|---|---|---|---|---|---|---|---|
| | | | | First | | | | Second | Finish | | | |
| No. | Steel No. | $Ac_3$ temperature (° C.) | Annealing temperature (° C.) | average cooling rate (° C./s) | Ms temperature (° C.) | Holding temperature (° C.) | Holding time (s) | average cooling rate (° C./s) | cooling temperature (° C.) | Holding temperature (° C.) | Holding time (s) | Remarks |
| 1 | A | 826 | 850 | 15 | 389 | 400 | 200 | 501 | 24 | 189 | 960 | Conforming steel |
| 2 | B | 802 | 880 | 16 | 307 | 410 | 180 | 515 | 24 | 221 | 680 | Conforming steel |
| 3 | C | 802 | 900 | 12 | 372 | 530 | 220 | 677 | 22 | 234 | 880 | Conforming steel |
| 4 | D | 878 | 900 | 16 | 351 | 420 | 250 | 529 | 23 | 230 | 780 | Conforming steel |
| 5 | E | 820 | 880 | 12 | 380 | 510 | 240 | 633 | 35 | 220 | 780 | Conforming steel |
| 6 | F | 785 | 880 | 16 | 321 | 410 | 260 | 504 | 32 | 188 | 960 | Conforming steel |
| 7 | G | 807 | 870 | 15 | 356 | 430 | 150 | 535 | 29 | 191 | 720 | Conforming steel |
| 8 | H | 799 | 900 | 16 | 316 | 410 | 190 | 511 | 27 | 231 | 740 | Conforming steel |
| 9 | I | 822 | 890 | 14 | 399 | 480 | 280 | 608 | 24 | 197 | 720 | Conforming steel |
| 10 | J | 803 | 860 | 15 | 366 | 400 | 150 | 487 | 35 | 200 | 900 | Conforming steel |
| 11 | K | 821 | 910 | 17 | 375 | 390 | 150 | 479 | 31 | 196 | 820 | Conforming steel |
| 12 | L | 857 | 910 | 16 | 362 | 430 | 150 | 528 | 34 | 230 | 760 | Conforming steel |
| 13 | M | 875 | 890 | 16 | 364 | 420 | 160 | 521 | 29 | 226 | 720 | Conforming steel |
| 14 | N | 817 | 870 | 10 | 379 | 580 | 190 | 740 | 25 | 190 | 580 | Conforming steel |
| 15 | O | 798 | 890 | 13 | 345 | 510 | 190 | 633 | 35 | 215 | 820 | Conforming steel |
| 16 | P | 823 | 890 | 16 | 345 | 400 | 60 | 485 | 36 | 242 | 480 | Conforming steel |
| 17 | Q | 804 | 860 | 15 | 379 | 420 | 170 | 525 | 26 | 210 | 820 | Conforming steel |
| 18 | R | 835 | 870 | 14 | 351 | 460 | 130 | 585 | 21 | 233 | 640 | Conforming steel |
| 19 | S | 865 | 900 | 17 | 378 | 400 | 150 | 492 | 31 | 225 | 960 | Conforming steel |
| 20 | T | 862 | 950 | 17 | 368 | 440 | 120 | 548 | 29 | 218 | 920 | Conforming steel |
| 21 | U | 801 | 860 | 12 | 379 | 510 | 180 | 643 | 28 | 212 | 860 | Comparative steel |
| 22 | V | 814 | 800 | 12 | 299 | 450 | 160 | 565 | 26 | 210 | 600 | Comparative steel |
| 23 | W | 786 | 920 | 17 | 366 | 410 | 190 | 515 | 24 | 209 | 600 | Comparative steel |
| 24 | X | 883 | 900 | 16 | 372 | 420 | 190 | 517 | 32 | 198 | 840 | Comparative steel |
| 25 | Y | 858 | 900 | 13 | 406 | 500 | 170 | 632 | 26 | 205 | 840 | Comparative steel |
| 26 | Z | 760 | 900 | 12 | 319 | 530 | 150 | 669 | 28 | 234 | 820 | Comparative steel |
| 27 | AA | 823 | 860 | 12 | 390 | 500 | 170 | 620 | 35 | 204 | 600 | Comparative steel |
| 28 | AB | 822 | 870 | 13 | 359 | 480 | 220 | 608 | 24 | 221 | 600 | Comparative steel |
| 29 | G | 807 | 800 | 13 | 356 | 400 | 180 | 492 | 31 | 243 | 600 | Comparative steel |
| 30 | G | 807 | 830 | 2 | 356 | 480 | 150 | 603 | 28 | 192 | 800 | Comparative steel |
| 31 | G | 807 | 830 | 7 | 356 | 610 | 140 | 779 | 26 | 196 | 800 | Comparative steel |
| 32 | G | 807 | 830 | 16 | 356 | 350 | 240 | 435 | 24 | 220 | 960 | Comparative steel |
| 33 | G | 807 | 850 | 14 | 356 | 420 | 0.3 | 525 | 26 | 199 | 960 | Comparative steel |
| 34 | G | 807 | 850 | 12 | 356 | 500 | 1100 | 632 | 26 | 177 | 960 | Comparative steel |
| 35 | H | 799 | 880 | 15 | 316 | 420 | 170 | 110 | 32 | 214 | 600 | Conforming steel |

TABLE 2-continued

| | | Annealing conditions | | | | | | | | Overaging treatment conditions | | |
|---|---|---|---|---|---|---|---|---|---|---|---|---|
| | | | | First | | | | Second | Finish | | | |
| No. | Steel No. | $Ac_3$ temperature (° C.) | Annealing temperature (° C.) | average cooling rate (° C./s) | Ms temperature (° C.) | Holding temperature (° C.) | Holding time (s) | average cooling rate (° C./s) | cooling temperature (° C.) | Holding temperature (° C.) | Holding time (s) | Remarks |
| 36 | H | 799 | 880 | 16 | 316 | 410 | 160 | 80 | 29 | 220 | 600 | Comparative steel |
| 37 | H | 799 | 880 | 16 | 316 | 390 | 180 | 280 | 180 | 206 | 600 | Comparative steel |
| 38 | H | 799 | 880 | 15 | 316 | 420 | 150 | 373 | 140 | 198 | 600 | Conforming steel |
| 39 | H | 799 | 880 | 13 | 316 | 480 | 140 | 601 | 29 | 260 | 600 | Comparative steel |
| 40 | H | 799 | 880 | 14 | 316 | 460 | 170 | 581 | 24 | 151 | 600 | Conforming steel |
| 41 | H | 799 | 880 | 14 | 316 | 470 | 150 | 585 | 31 | 220 | 1560 | Comparative steel |

For each of the resulting steel sheets, the metallic microstructure was quantified, and a tensile test and a delayed fracture resistance evaluation test were further performed.

The metallic microstructure was quantified by polishing an L-section (a section parallel to the rolling direction and perpendicular to the steel sheet surface) of the steel sheet, then etching the section in nital, observing the section at a ¼ thickness position from the steel sheet surface with a SEM at a magnification of 2,000× in four fields of view, and subjecting a captured microstructure image to image analysis. Here, tempered martensite is a microstructure that appears gray in SEM. On the other hand, bainite and ferrite are regions that appear a black contrast in SEM. Although tempered martensite and bainite include trace amounts of carbides, nitrides, sulfides, and oxides inside thereof, it is difficult to exclude them, and thus area fractions of regions that include these were measured as the area fractions of tempered martensite and bainite. In the metallic microstructure observed, ferrite is a microstructure that is formed by transformation from austenite at a relatively high temperature and composed of grains with a bcc lattice. Bainite is a microstructure that is formed from austenite at a relatively low temperature (equal to or higher than the martensite transformation temperature) and that contains spherical carbides dispersed in lath- or plate-shaped ferrite. Pearlite is a microstructure in which cementite is precipitated in ferrite in a lamellar form.

Regarding the measurement of retained austenite, a surface layer of the steel sheet was subjected to chemical polishing with oxalic acid to a depth of 200 μm, and the surface of the sheet was analyzed by an X-ray diffraction intensity method. Calculations were made using integral intensities of peaks of (200)α, (211)α, (220)α, (200)γ, (220)γ, and (311)γ diffraction planes measured with Mo—$K_\alpha$ radiation.

The area fraction of retained austenite determined as described above was subtracted from 100%, and the residual area fraction was distributed in the proportion of tempered martensite, bainite, ferrite, and pearlite determined by the observation of the microstructure image obtained with the SEM using a point counting method. Thus, the area fractions of tempered martensite, bainite, ferrite, pearlite, and retained austenite were specified.

The average amount of C in retained austenite was determined by calculating a lattice constant ($\alpha_\gamma$) of γ from a {220} peak angle of γ using a Co—$K_\alpha$ radiation source, and substituting the amounts of alloying elements contained into the following formula.

$$\alpha_\gamma=3.578+0.00095(\%\ Mn)+0.022(\%\ N)+0.0056(\%\ Al)+0.033(\%\ C)$$

In the formula, (% Mn), (% N), and (% Al) are the contents of Mn, N, and Al, respectively. (% C) is the average amount of C in retained austenite.

In quantification of the sizes of carbides in tempered martensite, an L-section (a vertical section parallel to the rolling direction) of the steel sheet was polished and then etched in nital, and the section was observed at a ¼ thickness position from the steel sheet surface with a SEM at a magnification of 10,000× in two fields of view. In the observation image, white particles that were finely dispersed in the tempered martensite microstructure were regarded as carbides and appropriately enlarged, and the lengths of the major axes of the carbides were measured. The carbides were assumed to be elliptical or acicular to specify the major axes. Specifically, in three martensite blocks, the major axes of five carbides were measured from each of the three martensite blocks and averaged. The average was defined as the average particle size of carbides in tempered martensite.

In the tensile test, a JIS No. 5 test piece for tensile test was cut out such that the rolling direction was the longitudinal direction, and a tensile test (in accordance with JIS 22241) was performed to evaluate TS and E1.

The microhardness was measured using nanoindentation at a load of 100 μN at a ¼ thickness position on a polished sheet surface. The measurement was performed at five points in each of the bainite and tempered martensite microstructures, and the average values were determined. The difference thereof was defined as the hardness difference. A Triboindenter manufactured by Hysitron, Inc. was used as an indentation device, the maximum load was 500 μN, and a Berkovich indenter with an angle between opposite edges of 115 degrees was used.

In the evaluation of delayed fracture resistance of the steel sheet, delayed fracture of the base material of the steel sheet was evaluated.

The evaluation of delayed fracture of the base material of the steel sheet was performed by taking a strip test specimen from the obtained steel sheet at a position ¼ of the width of the coil so as to have a size of 30 mm in a rolling direction and a size of 100 mm in a direction perpendicular to the rolling direction. Edge surfaces of the test specimen having a length of 100 mm were formed by shearing. The test specimen was subjected to bending directly subsequent to shearing (without being subjected to machining to remove burrs) such that the burrs were located on the outer peripheral side of bending. The test specimen was fixed with bolts so as to maintain the shape of the test specimen during the bend forming. In the shearing, the clearance was set to 15%, and the rake angle was set to 0 degree. The bending was performed with a bend radius that satisfied R/t=4, where R represents a tip bend radius and t represents a sheet thickness (where the sheet thickness t was 1.2 mm, and the bend forming was performed with a punch having a punch tip radius of 5.0 mm) such that the inside angle of the tip was 90 degrees (V-bend). The punch used was a U-shaped punch having a tip with the above radius (a punch including a semicircular tip R portion and a body having a thickness of 2R). A die having a corner R of 30 mm was used. The depth the punch was pressed against the steel sheet was adjusted to form the steel sheet such that the bending angle of the tip was 90 degrees (V-shape). The test specimen was pinched and fastened using a hydraulic jack such that the distance between flange ends of straight portions of the test specimen having been subjected to the bend forming was equal to that of the test specimen during the bend forming (such that a gap between the straight portions due to springback was cancelled out) and then fastened with bolts in this state. The bolts were fixed so as to penetrate through holes having an elliptical shape (minor axis: 10 mm, major axis: 15 mm) and formed in advance in the strip test specimen at positions 10 mm inside from the respective short-side edges. The resulting test specimen fastened with the bolts was immersed in one liter or more per test specimen of hydrochloric acid (an aqueous hydrogen chloride solution) having a pH of 3, and a test was performed at an aqueous solution temperature of 25° C. while the pH was controlled to be constant. The presence or absence of microcracks (initial state of delayed fracture) that could be visually observed (having a length of 1 mm or more) was constantly examined visually or using a camera. The time taken from the start of the immersion until the start of the formation of microcracks was measured as a delayed-fracture time.

With an increase in strength of steel sheets, a concern about delayed fractures increases. Thus, even among high strength steel sheets, there is a difference in delayed fracture property. When the fracture time was $10^{(-0.0055\times(TS-1760)+0.3)}$ hours (10 to the power of (−0.0055×(TS−1760)+0.3) hours) or more, the steel sheet was considered to be excellent in the delayed fracture property and evaluated as "○" (pass). When the fracture time was less than the above value, the steel sheet was evaluated as "x" (fail).

TABLE 3

| | | Microstructure | | | | | | | | | | |
|---|---|---|---|---|---|---|---|---|---|---|---|---|
| No. | Steel No. | Area fraction of bainite (%) | Area fraction of ferrite and pearlite (%) | Area fraction of tempered martensite (%) | Area fraction of retained γ (%) | Amount of C in retained γ (mass %) (*1) | Carbide size (μm) (*2) | Hardness difference (GPa) (*3) | Tensile strength (MPa) | Elongation (%) | Delayed fracture resistance | Remarks |
| 1 | A | 23 | 0 | 72 | 5 | 0.7 | 0.10 | 2.5 | 1605 | 12 | ○ | Conforming steel |
| 2 | B | 21 | 0 | 72 | 7 | 0.7 | 0.16 | 3.4 | 1964 | 13 | ○ | Conforming steel |
| 3 | C | 33 | 0 | 63 | 4 | 1.2 | 0.22 | 9.2 | 1590 | 13 | ○ | Conforming steel |
| 4 | D | 29 | 0 | 62 | 9 | 1.0 | 0.08 | 4.3 | 1890 | 15 | ○ | Conforming steel |
| 5 | E | 34 | 0 | 63 | 3 | 1.1 | 0.16 | 8.6 | 1636 | 12 | ○ | Conforming steel |
| 6 | F | 29 | 0 | 59 | 12 | 0.8 | 0.05 | 3.4 | 1724 | 17 | ○ | Conforming steel |
| 7 | G | 18 | 0 | 78 | 4 | 0.8 | 0.07 | 5.1 | 1779 | 12 | ○ | Conforming steel |
| 8 | H | 22 | 0 | 71 | 7 | 0.7 | 0.19 | 3.4 | 1898 | 13 | ○ | Conforming steel |
| 9 | I | 37 | 0 | 59 | 4 | 1.0 | 0.07 | 9.5 | 1525 | 13 | ○ | Conforming steel |
| 10 | J | 17 | 0 | 75 | 8 | 0.7 | 0.06 | 2.5 | 1584 | 13 | ○ | Conforming steel |
| 11 | K | 17 | 0 | 80 | 3 | 0.6 | 0.08 | 1.6 | 1650 | 11 | ○ | Conforming steel |
| 12 | L | 18 | 0 | 77 | 5 | 0.9 | 0.12 | 5.1 | 1789 | 12 | ○ | Conforming steel |
| 13 | M | 19 | 0 | 74 | 7 | 0.9 | 0.08 | 4.3 | 1817 | 13 | ○ | Conforming steel |
| 14 | N | 31 | 0 | 65 | 4 | 0.7 | 0.05 | 9.7 | 1481 | 12 | ○ | Conforming steel |
| 15 | O | 27 | 0 | 68 | 5 | 1.2 | 0.12 | 12.1 | 1735 | 13 | ○ | Conforming steel |
| 16 | P | 16 | 0 | 81 | 3 | 0.7 | 0.21 | 2.5 | 1844 | 11 | ○ | Conforming steel |
| 17 | Q | 20 | 0 | 74 | 6 | 0.7 | 0.12 | 4.3 | 1547 | 12 | ○ | Conforming steel |
| 18 | R | 17 | 0 | 76 | 7 | 1.0 | 0.15 | 7.7 | 1779 | 13 | ○ | Conforming steel |
| 19 | S | 17 | 0 | 77 | 6 | 0.8 | 0.09 | 2.5 | 1711 | 12 | ○ | Conforming steel |

TABLE 3-continued

| No. | Steel No. | Microstructure: Area fraction of bainite (%) | Area fraction of ferrite and pearlite (%) | Area fraction of tempered martensite (%) | Area fraction of retained γ (%) | Amount of C in retained γ (mass %) (*1) | Carbide size (μm) (*2) | Hardness difference (GPa) (*3) | Tensile strength (MPa) | Elongation (%) | Delayed fracture resistance | Remarks |
|---|---|---|---|---|---|---|---|---|---|---|---|---|
| 20 | T | 20 | 0 | 74 | 6 | 0.9 | 0.11 | 6.0 | 1635 | 12 | ○ | Conforming steel |
| 21 | U | 26 | 0 | 67 | 7 | 1.2 | 0.12 | 12.1 | 1430 | 14 | x | Comparative steel |
| 22 | V | 20 | 0 | 73 | 7 | 0.9 | 0.11 | 6.9 | 2124 | 13 | x | Comparative steel |
| 23 | W | 22 | 0 | 77 | 1 | 0.3 | 0.41 | 3.4 | 1604 | 8 | x | Comparative steel |
| 24 | X | 22 | 0 | 68 | 10 | 1.0 | 0.08 | 4.3 | 1751 | 15 | x | Comparative steel |
| 25 | Y | 24 | 13 | 61 | 2 | 1.2 | 0.21 | 11.2 | 1424 | 14 | x | Comparative steel |
| 26 | Z | 22 | 0 | 67 | 11 | 1.2 | 0.21 | 13.8 | 1608 | 16 | x | Comparative steel |
| 27 | AA | 24 | 0 | 74 | 2 | 1.1 | 0.11 | 11.2 | 1635 | 11 | x | Comparative steel |
| 28 | AB | 29 | 0 | 65 | 6 | 1.0 | 0.14 | 9.5 | 1723 | 14 | x | Comparative steel |
| 29 | G | 20 | 18 | 58 | 4 | 0.6 | 0.24 | 2.5 | 1410 | 16 | x | Comparative steel |
| 30 | G | 20 | 12 | 64 | 4 | 1.0 | 0.07 | 9.5 | 1433 | 15 | x | Comparative steel |
| 31 | G | 24 | 20 | 53 | 3 | 0.4 | 0.08 | 4.5 | 1354 | 10 | ○ | Comparative steel |
| 32 | G | 23 | 0 | 72 | 5 | 0.4 | 0.42 | 1.3 | 1580 | 10 | x | Comparative steel |
| 33 | G | 0 | 0 | 100 | 0 | — | 0.09 | — | 1810 | 6 | ○ | Comparative steel |
| 34 | G | 89 | 0 | 0 | 11 | 1.0 | 0.01 | 1.2 | 1048 | 23 | ○ | Comparative steel |
| 35 | H | 20 | 0 | 75 | 5 | 0.8 | 0.34 | 4.3 | 1715 | 12 | ○ | Conforming steel |
| 36 | H | 19 | 0 | 74 | 7 | 0.7 | 0.49 | 3.4 | 1675 | 13 | × | Comparative steel |
| 37 | H | 19 | 0 | 73 | 8 | 0.6 | 0.41 | 1.6 | 1684 | 13 | x | Comparative steel |
| 38 | H | 18 | 0 | 75 | 7 | 0.8 | 0.06 | 4.3 | 1699 | 13 | ○ | Conforming steel |
| 39 | H | 19 | 0 | 75 | 6 | 1.1 | 0.42 | 1.8 | 1657 | 13 | x | Comparative steel |
| 40 | H | 22 | 0 | 74 | 4 | 1.0 | 0.05 | 7.7 | 1798 | 12 | ○ | Conforming steel |
| 41 | H | 20 | 0 | 74 | 6 | 1.0 | 0.41 | 8.6 | 1696 | 13 | x | Comparative steel |

(*1): Average amount of C in retained austenite (mass %)
(*2): Average particle size of carbides in tempered martensite (μm)
(*3): Hardness difference in microhardness between bainite and the tempered martensite (GPa)

The steels having appropriate chemical compositions and obtained under appropriate hot-rolling conditions and annealing conditions each had a tensile strength TS of 1,470 MPa or more. Furthermore, 2% or more of retained austenite is obtained in terms of area fraction, the retained austenite having an average amount of C of 0.5% by mass or more, and an elongation of 11% or more is obtained. Regarding the delayed fracture resistance of the base materials of the steel sheets, the fracture time is $10^{(-0.0055\times(TS-1760)+0.3)}$ hours or more, and excellent properties for delayed fractures are obtained. The steel sheets according to aspects of the present invention have a tensile strength of 1,470 MPa or more and an elongation of 11% or more, and have a feature that the fracture time is $10^{(-0.0055\times(TS-1760)+0.3)}$ hours or more in the delayed fracture resistance evaluation test. The steel sheets of Comparative Examples do not satisfy one of those conditions.

Example 2

A steel sheet manufactured under the manufacturing condition No. 1 (conforming steel) in Table 2 of Example 1 was subjected to galvanizing treatment to prepare a galvanized steel sheet, and the galvanized steel sheet was subjected to press forming to manufacture a member of the inventive example. Furthermore, a galvanized steel sheet manufactured by subjecting a steel sheet manufactured under the manufacturing condition No. 1 (conforming steel) in Table 2 of Example 1 to galvanizing treatment and a galvanized steel sheet manufactured by subjecting a steel sheet manufactured under the manufacturing condition No. 2 (conforming steel) in Table 2 of Example 1 to galvanizing treatment were joined together by spot welding to manufacture a member of the inventive example. These members of the inventive examples have a tensile strength TS of 1,470 MPa or more and have excellent formability and delayed fracture resistance. This demonstrates that these members are suitable for use in, for example, automotive parts.

Similarly, a steel sheet manufactured under the manufacturing condition No. 1 (conforming example) in Table 2 of Example 1 was subjected to press forming to manufacture a member of the inventive example. Furthermore, a steel sheet manufactured under the manufacturing condition No. 1 (conforming example) in Table 2 of Example 1 and a steel sheet manufactured under the manufacturing condition No. 2 (conforming example) in Table 2 of Example 1 were joined together by spot welding to manufacture a member of the inventive example. These members of the inventive examples have a tensile strength TS of 1,470 MPa or more and have excellent formability and delayed fracture resistance. This demonstrates that these members are suitable for use in, for example, automotive parts.

INDUSTRIAL APPLICABILITY

According to aspects of the present invention, a high-strength steel sheet having excellent formability and delayed fracture resistance is provided. This improvement in properties enables a high-strength steel sheet for cold press forming to be applied to parts that are difficult to form, and contributes to improvements in the strengths of parts and reductions in the weights of the parts.

The invention claimed is:

1. A steel sheet comprising:

a chemical composition containing, by mass %,

C: 0.20% or more and 0.40% or less,

Si: more than 1.0% and 3.0% or less,

Mn: 1.5% or more and 3.5% or less,

P: 0.002% or more and 0.010% or less,

S: 0.0002% or more and 0.0020% or less, sol. Al: 0.40% or less (not including 0%), and N: 0.0100% or less, with the balance being Fe and incidental impurities;

a steel microstructure containing, in area fraction, tempered martensite: 45% or more and 83% or less, bainite: 15% or more and 53% or less, and retained austenite: 2% or more and 20% or less, wherein carbides in the tempered martensite have an average particle size of 0.40 μm or less, an average amount of C in the retained austenite is 0.5% by mass or more; and optionally a coated layer on a surface of the steel sheet, a tensile strength is 1,470 MPa or more, and a fracture time of the steel sheet is $10^{(-0.0055\times(TS-1760)+0.3)}$ hours or more, in which TS is the tensile strength in MPa of the steel sheet, wherein the fracture time is measured in hydrochloric acid kept at 25° C. and a pH of 3, after bending is performed with a bend radius that satisfies R/t=4, where R represents a tip bend radius and t represents a sheet thickness, to form V-bend where inside angle of the tip is 90 degrees.

2. The steel sheet according to claim 1, wherein the chemical composition further contains, by mass %, at least one of following (A) to (D);

(A) one or more selected from:

Nb: 0.1% or less,

Ti: 0.10% or less,

B: 0.0050% or less,

Cu: 1% or less, and

Ni: 1% or less, (B) one or more selected from:

Cr: 1.0% or less,

Mo: less than 0.3%,

V: 0.45% or less,

Zr: 0.2% or less, and

W: 0.2% or less, (C) one or two selected from:

Sb: 0.1% or less, and

Sn: 0.1% or less, (D) one or more selected from:

Ca: 0.0050% or less,

Mg: 0.01% or less, and

REM: 0.01% or less.

3. A method for manufacturing a steel sheet, the method being a method for manufacturing the steel sheet according to claim 2, the method comprising:

a hot rolling step of hot-rolling a steel slab to obtain a hot-rolled steel sheet;

a cold rolling step of, after the hot rolling step, cold-rolling the hot-rolled steel sheet to obtain a cold-rolled steel sheet;

a continuous annealing step of, after the cold rolling step, annealing the cold-rolled steel sheet at an annealing temperature equal to or higher than an Aca temperature for a soaking time of 15 seconds or more, subsequently cooling the resulting steel sheet to a holding temperature of an Ms temperature or higher and 600° C. or lower at a first average cooling rate of 5° C./s or more, holding the steel sheet at the holding temperature for a holding time of 1 second or more and 1,000 seconds or less, and cooling the steel sheet to a finish cooling temperature of 150° C. or lower at a second average cooling rate of 100° C./s or more;

an overaging treatment step of, after the continuous annealing step, holding the steel sheet in a temperature range of 150° C. or higher and 250° C. or lower for 30 seconds or more and 1,500 seconds or less; and optionally, before or after the overaging treatment step, a coating step of subjecting a surface of the steel sheet to coating treatment.

4. A method for manufacturing a member, the method comprising a step of subjecting the steel sheet manufactured by the method for manufacturing the steel sheet according to claim 3 to at least one of forming and joining.

5. The steel sheet according to claim 2, wherein a hardness difference in microhardness between the bainite and the tempered martensite is 1.5 GPa or more.

6. A member obtained by subjecting the steel sheet according to claim 5 to at least one of forming and joining.

7. A method for manufacturing a steel sheet, the method being a method for manufacturing the steel sheet according to claim 5, the method comprising:

a hot rolling step of hot-rolling a steel slab to obtain a hot-rolled steel sheet;

a cold rolling step of, after the hot rolling step, cold-rolling the hot-rolled steel sheet to obtain a cold-rolled steel sheet;

a continuous annealing step of, after the cold rolling step, annealing the cold-rolled steel sheet at an annealing temperature equal to or higher than an $Ac_3$ temperature for a soaking time of 15 seconds or more, subsequently cooling the resulting steel sheet to a holding temperature of an Ms temperature or higher and 600° C. or lower at a first average cooling rate of 5° C./s or more, holding the steel sheet at the holding temperature for a holding time of 1 second or more and 1,000 seconds or less, and cooling the steel sheet to a finish cooling temperature of 150° C. or lower at a second average cooling rate of 100° C./s or more;

an overaging treatment step of, after the continuous annealing step, holding the steel sheet in a temperature range of 150° C. or higher and 250° C. or lower for 30 seconds or more and 1,500 seconds or less; and optionally, before or after the overaging treatment step, a coating step of subjecting a surface of the steel sheet to coating treatment.

8. A method for manufacturing a member, the method comprising a step of subjecting the steel sheet manufactured by the method for manufacturing the steel sheet according to claim 7 to at least one of forming and joining.

9. A member obtained by subjecting the steel sheet according to claim 2 to at least one of forming and joining.

10. The steel sheet according to claim 1, wherein a hardness difference in microhardness between the bainite and the tempered martensite is 1.5 GPa or more.

11. A member obtained by subjecting the steel sheet according to claim 10 to at least one of forming and joining.

12. A method for manufacturing a steel sheet, the method being method for manufacturing the steel sheet according to claim 10, the method comprising:

a hot rolling step of hot-rolling a steel slab to obtain a hot-rolled steel sheet;

a cold rolling step of, after the hot rolling step, cold-rolling the hot-rolled steel sheet to obtain a cold-rolled steel sheet;

a continuous annealing step of, after the cold rolling step, annealing the cold-rolled steel sheet at an annealing temperature equal to or higher than an Acs temperature for a soaking time of 15 seconds or more, subsequently cooling the resulting steel sheet to a holding temperature of an Ms temperature or higher and 600° C. or lower at a first average cooling rate of 5° C./s or more, holding the steel sheet at the holding temperature for a holding time of 1 second or more and 1,000 seconds or less, and cooling the steel sheet to a finish cooling temperature of 150° C. or lower at a second average cooling rate of 100° C./s or more;

an overaging treatment step of, after the continuous annealing step, holding the steel sheet in a temperature range of 150° C. or higher and 250° C. or lower for 30 seconds or more and 1,500 seconds or less; and optionally, before or after the overaging treatment step, a coating step of subjecting a surface of the steel sheet to coating treatment.

13. A method for manufacturing a member, the method comprising a step of subjecting the steel sheet manufactured by the method for manufacturing the steel sheet according to claim 12 to at least one of forming and joining.

14. A member obtained by subjecting the steel sheet according to claim 1 to at least one of forming and joining.

15. A method for manufacturing a steel sheet, the method being a method for manufacturing the steel sheet according to claim 1, the method comprising:

a hot rolling step of hot-rolling a steel slab to obtain a hot-rolled steel sheet;

a cold rolling step of, after the hot rolling step, cold-rolling the hot-rolled steel sheet to obtain a cold-rolled steel sheet;

a continuous annealing step of, after the cold rolling step, annealing the cold-rolled steel sheet at an annealing temperature equal to or higher than an Acs temperature for a soaking time of 15 seconds or more, subsequently cooling the resulting steel sheet to a holding temperature of an Ms temperature or higher and 600° C. or lower at a first average cooling rate of 5° C./s or more, holding the steel sheet at the holding temperature for a holding time of 1 second or more and 1,000 seconds or less, and cooling the steel sheet to a finish cooling temperature of 150° C. or lower at a second average cooling rate of 100° C./s or more;

an overaging treatment step of, after the continuous annealing step, holding the steel sheet in a temperature range of 150° C. or higher and 250° C. or lower for 30 seconds or more and 1,500 seconds or less; and optionally, before or after the overaging treatment step, a coating step of subjecting a surface of the steel sheet to coating treatment.

16. A method for manufacturing a member, the method comprising a step of subjecting the steel sheet manufactured by the method for manufacturing the steel sheet according to claim 15 to at least one of forming and joining.

* * * * *